United States Patent [19]

Levy

[11] 4,440,094

[45] Apr. 3, 1984

[54] FLUID SELF-STEERING RAILWAY VEHICLE TRUCK

[75] Inventor: Samuel Levy, Schenectady, N.Y.

[73] Assignee: General Electric Company, Schenectady, N.Y.

[21] Appl. No.: 389,726

[22] Filed: Jun. 18, 1982

Related U.S. Application Data

[63] Continuation of Ser. No. 125,508, Feb. 28, 1980, abandoned.

[51] Int. Cl.[3] ..... B61C 3/00; B61C 9/50; B61F 5/38

[52] U.S. Cl. ..... 105/166; 105/136; 105/168; 105/224 R

[58] Field of Search ..... 105/136, 165, 166, 167, 105/168, 176, 197 B, 218 R, 218 A, 224 A, 224 R, 225, 133

[56] References Cited

U.S. PATENT DOCUMENTS

| | | | |
|---|---|---|---|
| 208,215 | 9/1878 | Vincent | 105/166 |
| 299,735 | 6/1884 | Candee | 105/168 |
| 2,952,224 | 9/1960 | Bachman | 105/224 R X |
| 3,789,770 | 2/1974 | List | 105/176 X |
| 3,893,485 | 7/1975 | Loukonen | 138/30 |
| 4,043,272 | 8/1977 | Jones, Jr. et al. | 105/136 |
| 4,136,620 | 1/1979 | Scheffel et al. | 105/182 R X |
| 4,164,188 | 8/1979 | Hallam et al. | 105/166 |
| 4,173,933 | 11/1979 | Kayserling | 105/224 R X |
| 4,178,965 | 12/1979 | Zahid | 138/30 |
| 4,186,776 | 2/1980 | Burton | 138/30 |

FOREIGN PATENT DOCUMENTS

| | | | |
|---|---|---|---|
| 7225 | 1/1980 | European Pat. Off. | 105/156 |
| 850623 | 9/1952 | Fed. Rep. of Germany | 105/168 |
| 929673 | 6/1963 | United Kingdom | 105/176 |

OTHER PUBLICATIONS

Hunting Stability of the Three Axle Locomotive Truck, ASME Publication, Paper No. 78-RT-6, published 1978.

*Primary Examiner*—Bruce H. Stoner, Jr.
*Assistant Examiner*—H. Beltran
*Attorney, Agent, or Firm*—Marvin Snyder; James C. Davis, Jr.

[57] ABSTRACT

Leading and trailing wheel set assemblies of a railway vehicle truck are interdependently steered while traversing a curve by employing the longitudinal forces generated thereby to reposition rub plates which contact associated wheel set assembly journal boxes.

6 Claims, 5 Drawing Figures

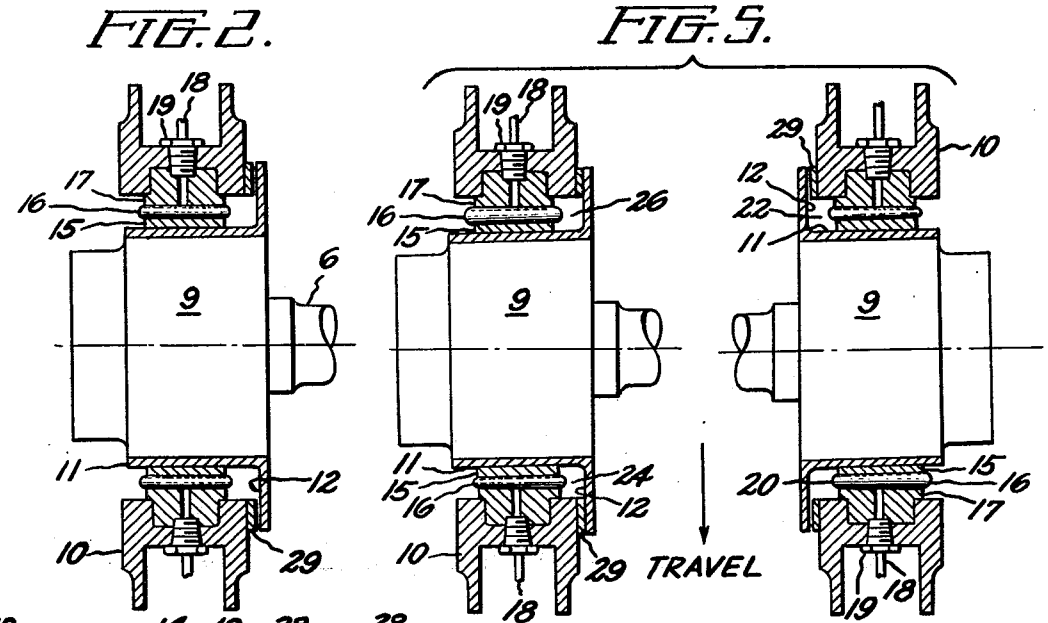
FIG. 5.
FIG. 2.
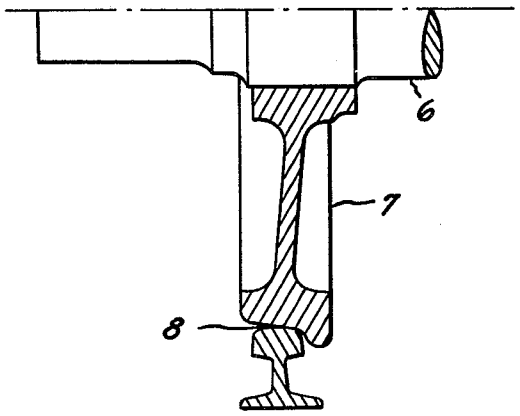
FIG. 3.
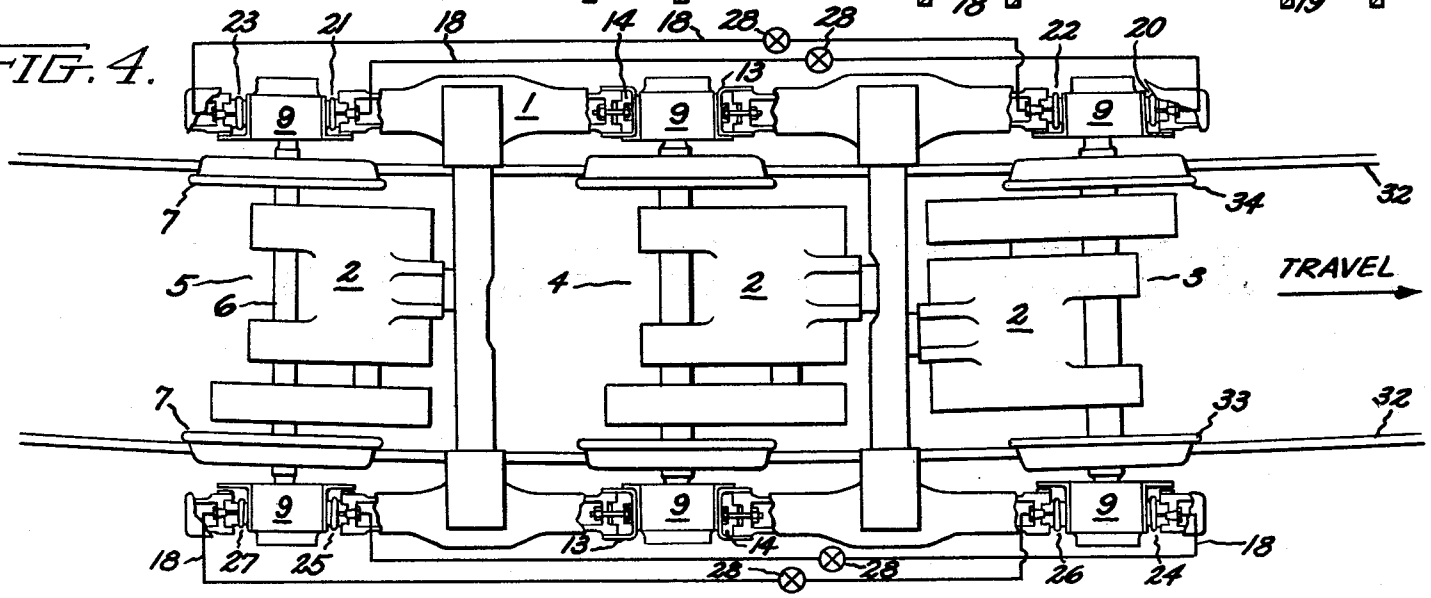
FIG. 4.

FLUID SELF-STEERING RAILWAY VEHICLE TRUCK

This application is a continuation of application Ser. No. 125,508, filed Feb. 28, 1980 now abandoned.

BACKGROUND OF THE INVENTION

This invention relates generally to railway vehicles and in particular to the improved steering of railway vehicles around curves.

In a conventional railway vehicle truck or "bogie", wheel set assemblies are restrained longitudinally and laterally by contact with rub plates on the truck frame to travel in nearly the same direction as the frame. On straight track the directional restraint of the wheel set assemblies is acceptable. However, on curving track it would be desirable for the leading wheel set assembly to angle in the direction of the curve, and the trailing wheel set assembly to angle opposite to the leading wheel set assembly. In this manner the truck would be "steered" around a curve.

These differences between preferred and actual wheel set angles are sufficient to develop lateral creep forces at the wheels which are limited only by wheel-rail friction. Such friction not only results in high levels of wear on both rails and wheels, but it is also a significant contributing factor to derailment by tipping the rail over. Reduction of these lateral forces is the primary object of this invention.

Although this problem is not confined to a particular type of railroad vehicle, it is however, particularly severe with large, 3-axle locomotive trucks since the difference between the preferred angle of travel of the leading and trailing wheel set assemblies is proportional to the truck length. The problem is further aggravated in that the tractive force of a locomotive exerted on an associated wheel set assembly pushes it against the truck frame, thereby further restraining the wheel set direction of travel to that of the frame. Furthermore, the wheel-rail friction of a locomotive is relatively large due in part to its characteristically heavy wheel loadings, and the resulting combination of this, together with the above-described strong lateral forces developed by the locomotive wheel set angular differences in a curve, can generate an increase in detrimental friction related affects such as noted hereinabove.

Accordingly, a certain amount of wheel set assembly angling is desirable while traversing curves to improve railway vehicle truck performance. However, a degradation of truck performance can result from insufficiently restrained wheel set assemblies as exemplified by the phenomenon of truck hunting defined herein as an oscillatory motion consisting of combined yawing and lateral displacement of the truck. Accordingly, it is another object of the present invention to avoid this type of performance degradation in a self-steered railway vehicle truck.

Prior self-steering truck designs as exemplified by U.S. Pat. No. 4,136,620 to Scheffel et al and U.S. Pat. No. 4,164,188 to Hallam et al have typically employed mechanically interconnected wheel sets. Such designs require a substantial amount of undercarriage space and are not easily adaptable to existing truck designs. Accordingly, it is still another object of the present invention to provide a new and improved self-steering railway vehicle truck which can be relatively easily employed in existing truck designs or retrofitted into existing trucks.

SUMMARY OF THE INVENTION

The above and other objects and advantages are achieved in a self-steering railway vehicle truck in which a leading and a trailing wheel set assembly are interdependently angled while traversing a curve such that the leading assembly is angled in the direction of the curve and the trailing assembly is angled in a direction opposite thereto through the employment of a means for repositioning the journal boxes associated with the leading and trailing wheel set assemblies. The repositioning means include a plurality of means for transmitting longitudinal forces exerted on load bearing surfaces of a wheel set assembly journal box when entering or leaving a curve, and conduits which interconnect preselected force transmitting means into sets whereby the force exerted on a first journal box load bearing surface is effectively transmitted to a second load bearing surface of the set for repositioning the journal boxes of associated wheel set assemblies. In a preferred embodiment a flow restricting device is included in the interconnecting conduits to selectively dampen the transmission of relatively short-lived forces such as those associated with the phenomena of truck hunting.

BRIEF DESCRIPTION OF THE DRAWING

For better understanding of the invention reference may be had to the accompanying drawing wherein:

FIG. 2 is a sectional view taken along line 2—2 of FIG. 1 looking in the direction of the arrows illustrating journal box load bearing surfaces and associated force transmitting means as operatively positioned in the truck of FIG. 1 when the truck is motionless;

FIG. 3 is a partial schematic view of a railway vehicle truck flanged wheel in a typical operative position with respect to an associated rail;

FIG. 4 is a schematic representation of the truck of FIG. 1 traveling in the direction indicated and illustrating the operation of the present invention during the traversal of a curve to the left; and FIG. 5 is an exploded partial view of FIG. 4 depicting portions of an operatively positioned leading wheel set assembly.

DETAILED DESCRIPTION OF THE INVENTION

Figure 1:
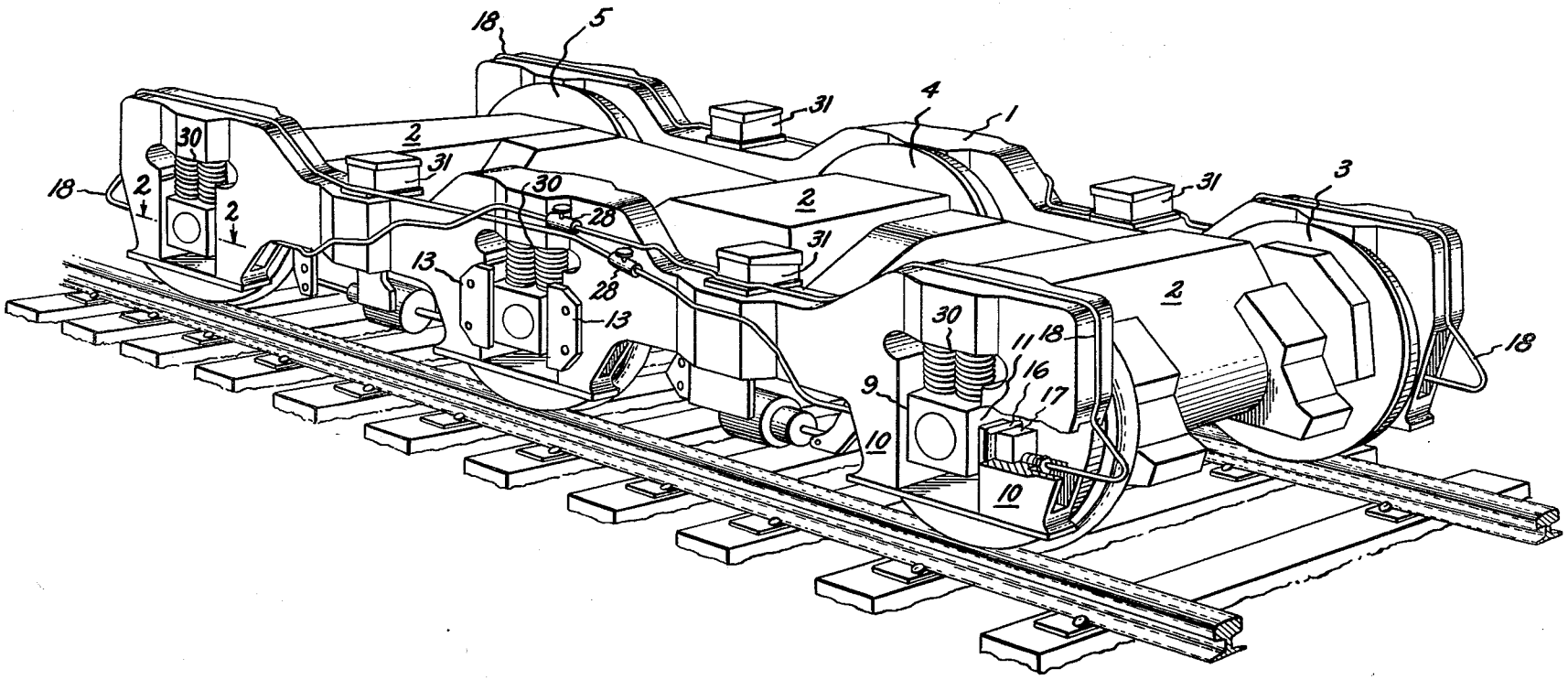
FIG. 1 is a perspective view of a self-steering railway vehicle truck constructed in accordance with an embodiment of the present invention.

As illustrated in FIG. 1, a self-steering railway vehicle truck includes a rigid truck frame 1 in which multiple wheel set assemblies are operatively positioned. The truck herein described is adapted for use in a large locomotive, and accordingly employs three wheel set assemblies driven by traction motors 2 including leading, middle and trailing wheel set assemblies denoted as 3, 4 and 5, respectively, for the direction of travel indicated. However, it will be appreciated that the present invention is not limited in practice to this embodiment and may be employed in conjunction with railway vehicle trucks of various constructions.

As best depicted in FIG. 4, each wheel set assembly includes an axle 6 and a pair of flanged wheels 7 nonrotatably mounted on the axle 6. The wheels 7 have a wheel tread conicity as depicted for a new wheel at 8 in FIG. 3. Each wheel set assembly also includes journal boxes 9 mounted adjacent the ends of the axle 6. The journal boxes are of a type well known in the prior art and 9 include bearings mounted about a section of the axle 6 which provide a means of rotation of the axle relative to the journal box. The bearing can be of any structure which allows rotation of the axle in the journal box. The type conventionally used in typical railway vehicle trucks is a tapered roller bearing, of the type manufactured by the Timken Company under the designation of Class GG. Such bearings are well known in the art and have been available prior to Feb. 28, 1980. If the invention is used as a retrofit of an existing railway vehicle truck, the bearing would be of the type previously used in the retrofitted truck.

The wheel set assemblies are operatively positioned in the truck frame by contact between journal box load bearing surfaces and juxtaposed rub plates carried by pedestal sections 10 of the frame 1. More specifically, and as best appreciated from FIGS. 2 and 5, the journal boxes 9 are equipped with longitudinal load bearing surfaces 11 and lateral load bearing surfaces 12. Conventionally the load bearing surfaces 11 and 12 are positioned adjacent fixed rub plates 13 with a small clearance therebetween as depicted in FIG. 4 for the middle wheel set assembly 4. The rub plates 13 are bolted to the sides of corresponding frame pedestal sections 10. Rub plate spacers 14 are bolted into recessed portions of the pedestal sections 10. According to the present invention the rub plates adjacent the journal box longitudinal load bearing surfaces of the leading and trailing wheel set assemblies 3 and 5, respectively, are not fixed, but are movable relative thereto.

In particular, and as can best be appreciated from FIG. 2, means are provided for interdependently repositioning the leading and trailing wheel set assemblies, which means includes a number of force transmitting means positioned in frame pedestal sections 10 adjacent corresponding journal boxes 9. In the embodiment herein illustrated each force transmitting means comprises a rub plate 15 affixed to an oil filled bellows 16 and engageably positioned with respect to a juxtaposed journal box longitudinal load bearing surface 11. The force transmitting means as depicted also includes an adapter plate 17 which is suitably affixed to the bellows 16 and attached to that portion of the truck frame pedestal section conventionally occupied by the rub plate spacers 13. Bellows 16 are of a type well known in the prior art, and may comprise, for example, the bellows manufactured by Firestone Industrial Rubber Products Company under the name Airstroke. Such bellows are advertised and illustrated in the 1970 Sweet's Product Design file, which is incorporated herein by reference. Of course, it is understood that alternative force transmitting means can be employed such as a hydraulic cylinder having a rub plate integral therewith. The hydraulic cylinder used would be of a conventional type well known in the prior art.

Preselected force transmitting means are interconnected by conduits 18 which are attached in flow communication with the force transmitting means by suitable connectors 19 to thereby form force transmitting sets. In particular, as depicted in FIG. 4 the force transmitting means 20 and 21 located on a left side of the frame 1 forward of the leading and trailing wheel set assemblies 3 and 5, respectively, define a first force transmitting set. Similarly, force transmitting means 22 and 23 define a second force transmitting set, force transmitting means 24 and 25 define a third force transmitting set, and force transmitting means 26 and 27 define a fourth force transmitting set.

In a preferred embodiment of this invention flow restricting devices 28 are included in the interconnecting conduits 18 and are of a suitable size so as to effectively dampen out forces transmitted of a relatively brief duration such as associated with truck hunting. Since the time required for a locomotive to transverse a curve is of the order of 5 seconds while hunting motions may have a period of about ¼ seconds, a suitable flow restricting device might dampen forces of less than 1 second without degrading the beneficial self-steering aspects of the present invention. Flow restricting devices 28 are of a type well known in the prior art, and may comprise, for example, a conventional fluid controlling valve. When the valve is partially open, the amount of fluid flowing through the valve during a time period of five seconds, such duration being generally equal to the time required to transverse a curve, is significant. However, the amount of fluid flowing through the valve during periods lasting less than one second, such as the duration of forces associated with truck hunting, is insignificant. The valve size and opening is such that the amount of fluid required to accomplish the steering function can flow through the valve in a time period of five seconds, but the amount of fluid required to initiate the steering function cannot flow through the valve in a time period of less than one second. Typical fluid controlling valves are manufactured by such companies as NuPro Company and Whitey Company, and are advertised in the 1979 catalog of the Whitey Company, which is incorporated herein by reference. Of course, it is understood that actual flow restricting device selection will involve consideration of design criteria surrounding a specific application such as the mass, inertia, and fluid volume of the particular wheel set used, as well as the mass of the rail vehicle on the truck.

In addition to the rub plates 15 adjacent load bearing surfaces 11, thrust rub plates 29 are suitably affixed to the pedestal sections 10 adjacent corresponding journal box lateral load bearing surfaces 12 of the leading and trailing wheel set assemblies 3 and 5. Thus, these wheel set assemblies are operatively constrained longitudinally and laterally in the truck frame 1 by contact with the rub plates 15 and 29.

The truck frame itself is horizontally positioned by springs 30 located intermediate the frame 1 and the journal box 9. The bolster (not shown) to which a railway vehicle body is connected typically rests above the truck frame 1 on bolster mounts 31.

In operation, the wheel set assemblies are typically oriented to travel in the direction of the longitudinal axis of the truck. Upon traversing the buildup of a curve in rails 32 the wheels in the leading wheel set assembly 3 attempt to continue traveling in the direction of the longitudinal axis of the truck. As a result, the outside wheel 33 tends to ride up on the rail 32 to a portion of the wheel tread having a greater radius due to the conicity of the wheel tread as depicted at 8 in FIG. 3. Simultaneously, the inside wheel 34 begins to travel on a portion of the wheel having a reduced radius. As a result, the tangential velocity of the wheels changes, with the outside wheel 33 having a greater tangential velocity than that of inside wheel 34. Due to this change in tangential velocity an increased longitudinal force is generated against the force transmitting means 24 by contact between the corresponding journal box longitudinal load bearing surface 11 and the rub plate 15. Similarly, the longitudinal force against the force transmitting means 26 is decreased. Through a corresponding mechanism a longitudinal force on force transmitting means 20 and 22 are decreased and increased, respectively, resulting from the decreased tangential velocity of the inside wheel 34.

These forces on a first force transmitting means from wheel tangential velocity variations in the buildup of a curve are transmitted to an associated force transmitting means of a force transmitting set. Accordingly, the increased longitudinal force against force transmitting means 24 forces oil out of the corresponding bellows 16 and through the conduit 18 to the bellows associated with the force transmitting means 25. Upon receipt of the transmitted oil the bellows associated with the force transmitting means 25 expands, thus forcing the rub plate affixed thereto to be repositioned aft. Through a similar mechanism the rub plates of force transmitting means 20, 22, and 27 are repositioned aft, and the rub plates of force transmitting means 24, 26, 21 and 23 are repositioned forward. This repositioning of the rub plates also effects a corresponding repositioning of the adjacent journal boxes in contact with the rub plates through the longitudinal load bearing surfaces 11. In this manner, the leading and trailing wheel set assemblies 3 and 5 are rotated about a vertical axis to a direction corresponding to the curvature of the rails 32. This can be appreciated from FIG. 5 in which the leading wheel set assembly 3 is in operative position angled into a left curve, with the bellows of force transmitting means 20 and 26 inflated, and of means 22 and 24 deflated. A similar mechanism upon leaving the curve will cause these wheel set assemblies to be repositioned to approximately their original positions relative to the truck longitudinal axis.

In computer simulations of a locomotive traveling at approximately 80 feet per second on a 1000 foot radius curve, the practice of the present invention enabled a calculated reduction in lateral forces from approximately 13,000 to 6,000 pounds for the most heavily loaded wheel without inclusion of the flow restricting devices 28. With the inclusion of a flow restricting device of the type described above to dampen out transmitted forces of a duration less than that assumed for a wheel tangential velocity induced force, the undesirable yawing oscillation of the truck frame such as that associated with truck hunting was substantially eliminated. Additionally, the lateral wheel force was further reduced to a highest value of less than 4,000 pounds.

Furthermore, the computer simulations demonstrated reductions of lateral to vertical force ratios from a maximum of about 0.2 for the leading and trailing wheel set assemblies 13 and 14. In particular, in a simulation not employing a flow restricting device 28, peak lateral to vertical force ratios were reduced to approximately half of their previous values.

Accordingly, lateral wheel forces are substantially reduced through the practice of the present invention. Similarly, unwanted wheel oscillations such as that associated with truck hunting can be significantly reduced through the practice of the present invention, particularly when a suitably selected flow restricting device is included therein. Finally, it will be appreciated that the present invention can be employed with relatively minor modifications in existing railway vehicle trucks.

The above described embodiment of this invention is intended to be exemplitive only and not limiting and it will be appreciated from the foregoing by those skilled in the art that many substitutions, alterations and changes may be made to the disclosed structure without departing from the spirit or scope of the invention.

What I claimed as new and desired to be secured by Letters Patent of the United States is:

1. In a railway vehicle truck having a longitudinal axis in its direction of travel and comprising a rigid truck frame, multiple wheel set assemblies including a leading wheel set assembly and a trailing wheel set assembly disposed aft of said leading wheel set assembly along said longitudinal truck axis, said wheel set assemblies each comprising an axle, a pair of flanged wheels having wheel tread conicity and mounted on said axle, and two journal boxes mounted adjacent opposite ends of said axle and operatively disposed in said truck frame so that each corresponding wheel set assembly is operatively positioned in said truck, each of said journal boxes including:

a bearing mounted about a section of said axle, said bearing supporting said axle and providing a means of rotation of said axle relative to said journal box, longitudinal load bearing surfaces disposed in planes substantially perpendicular to said longitudinal axis, said planes being disposed forward and aft of said axle along a line parallel to said longitudinal axis, and lateral load bearing surfaces disposed substantially orthogonal to said longitudinal load bearing surfaces, the improvement comprising:

means for repositioning said journal boxes of said leading and trailing wheel set assemblies with respect to said truck frame, said means including a plurality of fluid containing force transmitting means each positioned on said truck frame adjacent and movable relative to at least one of said longitudinal load bearing surfaces of at least one of said journal boxes of said leading and trailing wheel set assemblies, each of said force transmitting means including a rub plate portion adjacent and engageable with one of said longitudinal load bearing surfaces, with at least two of said force transmitting means defining a set; and conduits interconnecting said force transmitting means in each of said sets in flow communication.

2. The railway vehicle truck of claim 1 wherein:

a first and a third set of force transmitting means comprise said force transmitting means adjacent the forward-disposed longitudinal load bearing surfaces of said leading and trailing wheel set assembly journal boxes on a first and an opposite lateral side of said truck, respectively; and a second and a fourth set of force transmitting means comprise said force transmitting means adjacent the aft-disposed longitudinal load bearing surface of said leading and trailing wheel set assembly journal boxes on leading and trailing wheel set assembly journal boxes on the same first and said opposite second lateral sides of said truck, respectively.

3. The railway vehicle truck of claim 1 or claim 2 wherein said force transmitting means each includes a fluid-containing bellows disposed in force transmitting relationship with one of said adjacent journal box longitudinal load bearing surfaces through a rub plate affixed to said bellows and engageable with said longitudinal load bearing surface.

4. The railway vehicle truck of claim 1 or claim 2 wherein said force transmitting means each include a hydraulic cylinder disposed in force transmitting relationship with one of said adjacent journal box longitudinal load bearing surfaces.

5. The railway vehicle truck of claim 1 or claim 2 wherein said repositioning means further comprises a plurality of flow restricting devices, at least one of which is disposed in each of said interconnecting conduits in flow communication intermediate the force transmitting means of an associated set.

6. The railway vehicle truck of claim 5 wherein said flow restricting devices operate so that forces transmitted between the force transmitting means of an associated set, which forces are of a finite duration, but less than 1 second, fail to reposition said journal boxes.

* * * * *